US009926683B2

(12) United States Patent
Khachaturian et al.

(10) Patent No.: US 9,926,683 B2
(45) **Date of Patent: *Mar. 27, 2018**

(54) METHOD AND APPARATUS FOR ELEVATING A MARINE PLATFORM

(71) Applicants: Jon Khachaturian, Houston, TX (US); E. John Greeves, Houston, TX (US)

(72) Inventors: Jon Khachaturian, Houston, TX (US); E. John Greeves, Houston, TX (US)

(73) Assignee: VERSABAR, INC., Belle Chasse, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,554

(22) Filed: Oct. 10, 2016

(65) Prior Publication Data

US 2017/0096790 A1 Apr. 6, 2017

Related U.S. Application Data

(63) Continuation of application No. 14/753,879, filed on Jun. 29, 2015, now Pat. No. 9,464,396, which is a continuation of application No. 14/188,263, filed on Feb. 24, 2014, now Pat. No. 9,068,316, which is a continuation of application No. 13/741,690, filed on Jan. 15, 2013, now Pat. No. 8,657,532, which is a (Continued)

(51) Int. Cl.
*E02B 17/08* (2006.01)
*E02B 17/00* (2006.01)

(52) U.S. Cl.
CPC ..... *E02B 17/0809* (2013.01); *E02B 17/0034* (2013.01); *E02B 2017/0056* (2013.01)

(58) Field of Classification Search
CPC ..... E02B 17/0809; E02B 17/08; E02B 2017/0039
See application file for complete search history.

(56) References Cited

U.S. PATENT DOCUMENTS 2,946,557 A 7/1960 Suderow
3,053,050 A * 9/1962 Sommerer ..... B66F 3/28 187/215

(Continued)

FOREIGN PATENT DOCUMENTS

GB 2501459 A 10/2013
WO WO81-03191 A1 11/1981

(Continued)

*Primary Examiner* — Frederick L Lagman
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A method of elevating the deck area of a marine platform (e.g., oil and gas well drilling or production platform) utilizes a specially configured sleeve support to support the platform legs so that they can be cut. Once cut, rams or jacks elevate the platform above the cuts. The sleeve support is then connected (e.g., welded) to the platform leg and becomes part of the structural support for the platform. In one embodiment, two sleeves are employed. In another embodiment, the jacks or rams elevate in two stages including a first stage wherein one sleeve elevates and the other sleeve does not elevate and a second stage wherein both sleeves elevate together.

21 Claims, 19 Drawing Sheets

Related U.S. Application Data continuation of application No. 12/861,589, filed on Aug. 23, 2010, now Pat. No. 8,353,643, which is a continuation-in-part of application No. 11/749,587, filed on May 16, 2007, now Pat. No. 7,780,375.

(60) Provisional application No. 60/824,005, filed on Aug. 30, 2006, provisional application No. 61/356,813, filed on Jun. 21, 2010.

(56) References Cited

U.S. PATENT DOCUMENTS

| | | | | |
|---|---|---|---|---|
| 3,136,221 | A * | 6/1964 | Walker | F15B 15/16 91/168 |
| 3,195,313 | A | 7/1965 | Swatek, Jr. | |
| 3,495,806 | A | 2/1970 | Sutton | |
| 3,699,688 | A | 10/1972 | Estes | |
| 3,868,826 | A | 3/1975 | Landers | |
| 4,206,684 | A * | 6/1980 | Gosney | F15B 15/16 91/167 R |
| 4,678,372 | A | 7/1987 | Cousty | |
| 4,799,829 | A | 1/1989 | Kenny | |
| 5,445,476 | A | 8/1995 | Sgouros et al. | |
| 5,741,089 | A | 4/1998 | Gallaher et al. | |
| 5,800,093 | A | 9/1998 | Khachaturian | |
| 6,039,506 | A | 3/2000 | Khachaturian | |
| 6,668,746 | B1 | 12/2003 | Schia et al. | |
| 6,736,571 | B2 | 5/2004 | McCarthy et al. | |
| 6,840,713 | B1 | 1/2005 | Schia et al. | |
| 7,780,375 | B1 | 8/2010 | Khachaturian et al. | |
| 8,002,500 | B1 | 8/2011 | Khachaturian et al. | |
| 8,353,643 | B2 | 1/2013 | Khachaturian et al. | |
| 8,657,532 | B2 | 2/2014 | Greeves et al. | |
| 9,068,316 | B2 | 6/2015 | Khachaturian et al. | |
| 9,334,619 | B2 * | 5/2016 | Khachaturian | E02B 17/0809 |
| 9,464,396 | B2 | 10/2016 | Khachaturian et al. | |
| 2003/0108392 | A1 | 6/2003 | McCarthy et al. | |
| 2013/0168516 | A1 * | 7/2013 | Winter | F16M 13/022 248/274.1 |

FOREIGN PATENT DOCUMENTS

| | | | |
|---|---|---|---|
| WO | WO95-20074 | A1 | 7/1995 |
| WO | WO2011/162780 | A1 | 12/2011 |

* cited by examiner

METHOD AND APPARATUS FOR ELEVATING A MARINE PLATFORM

CROSS-REFERENCE TO RELATED APPLICATIONS

This is a continuation of U.S. patent application Ser. No. 14/753,879, filed 29 Jun. 2015 (issued as U.S. Pat. No. 9,464,396 on 11 Oct. 2016), which is a continuation of U.S. patent application Ser. No. 14/188,263, filed 24 Feb. 2014 (issued as U.S. Pat. No. 9,068,316 on 30 Jun. 2015), which is a continuation of U.S. patent application Ser. No. 13/741,690, filed 15 Jan. 2013 (issued as U.S. Pat. No. 8,657,532 on 25 Feb. 2014), which is a continuation of U.S. patent application Ser. No. 12/861,589, filed 23 Aug. 2010 (issued as U.S. Pat. No. 8,353,643 on 15 Jan. 2013), which is a continuation in part of U.S. patent application Ser. No. 11/749,587, filed 16 May 2007 (issued as U.S. Pat. No. 7,780,375 on 24 Aug. 2010), which claimed priority of U.S. Provisional Patent Application Ser. No. 60/824,005, filed 30 Aug. 2006, each of which is hereby incorporated herein by reference, and priority to each of which is hereby claimed.

U.S. patent application Ser. No. 12/861,589, filed 23 Aug. 2010, also claimed priority of U.S. Provisional Patent Application Ser. No. 61/356,813, filed 21 Jun. 2010, each of which is hereby incorporated herein by reference and priority to each of which is hereby claimed.

U.S. patent application Ser. No. 12/813,290, filed 10 Jun. 2010 (issued as U.S. Pat. No. 8,002,500 on 23 Aug. 2011), is hereby incorporated herein by reference.

International Patent Application No. PCT/US2010/046358, filed 23 Aug. 2010 (published as No. WO2011/162780 on 29 Dec. 2011), is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine platforms such as oil and gas well drilling platforms. More particularly, the present invention relates to an improved method and apparatus for elevating the deck area of a fixed marine platform to better protect equipment that is located on the deck area from the effects of a storm (e.g., hurricane, tsunami, typhoon) that generates heightened wave action.

2. General Background of the Invention

There are many fixed platforms located in oil and gas well drilling areas of oceans and seas of the world. Such marine platforms typically employ an undersea support structure that is commonly referred to as a jacket. These jackets can be many hundreds of feet tall, being sized to extend between the seabed and the water surface area. Jackets are typically constructed of a truss-like network of typically cylindrically shaped pipe, conduit or tubing that is welded together. The jackets can be secured to the seabed using pilings that are driven into the seabed. The jacket is then secured to the piling. The part of the offshore marine platform that extends above the jacket and above the water surface is typically manufactured on shore and placed upon the jacket using known lifting equipment such as a derrick barge. This upper portion is the working part of the platform that is inhabited by workers.

Marine platforms can be used to perform any number of functions that are associated typically with the oil and gas well drilling and production industry. Such platforms can be used to drill for oil and gas. Such platforms can also be used to produce wells that have been drilled. These fixed platforms typically provide a deck area that can be crowded with extensive equipment that is used for the drilling and/or production of oil and gas.

When storms strike over a body of water, offshore marine platforms are put at risk. While the jacket and platform are typically designed to resist hurricane force wind and wave action, equipment located on the deck of the marine platform can easily be damaged if hurricane generated wave action reaches the deck area.

An additional consequence of wave action reaching the platform deck is catastrophic platform collapse, which happened in several instances during recent storms (e.g., hurricane Katrina in the United States Gulf of Mexico).

BRIEF SUMMARY OF THE INVENTION

The present invention solves these prior art problems and shortcomings by providing a method and apparatus for elevating the deck area of an existing marine platform so that equipment that occupies the deck can be further distanced from the water surface. The method of the present invention provides more clearance, more freeboard and more protection to deck area equipment during severe storms such as hurricanes.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 13:
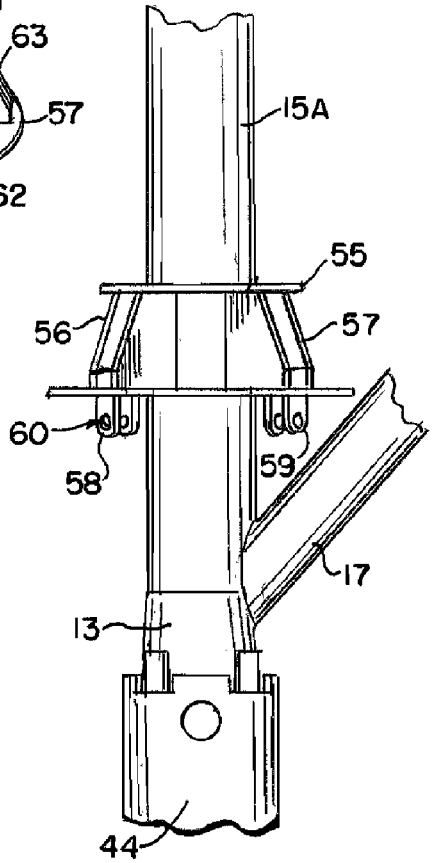
FIG. 13 is a partial elevation view of a preferred embodiment of the apparatus of the present invention illustrating placement of the upper ring.
Figure 14:
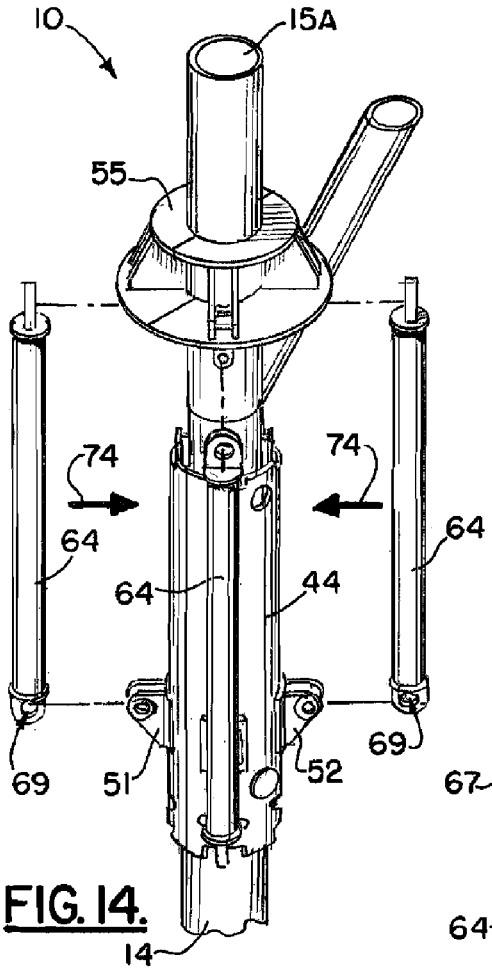
FIG. 14 is a partial perspective exploded view of a preferred embodiment of the apparatus of the present invention illustrating placement of the hydraulic pistons.
Figure 16:
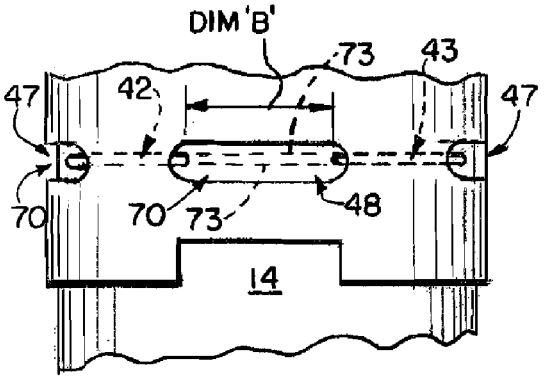
FIG. 16 is a fragmentary elevation view illustrating the method of the present invention, namely the step of completing the leg cuts.
Figure 15:
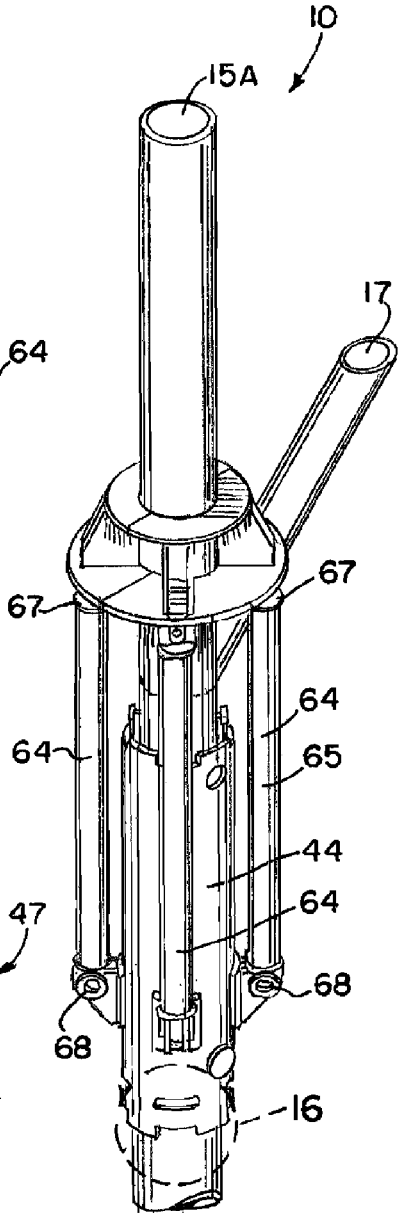
FIG. 15 is a partial perspective view of a preferred embodiment of the apparatus of the present invention illustrating placement of the hydraulic pistons.
Figure 17:
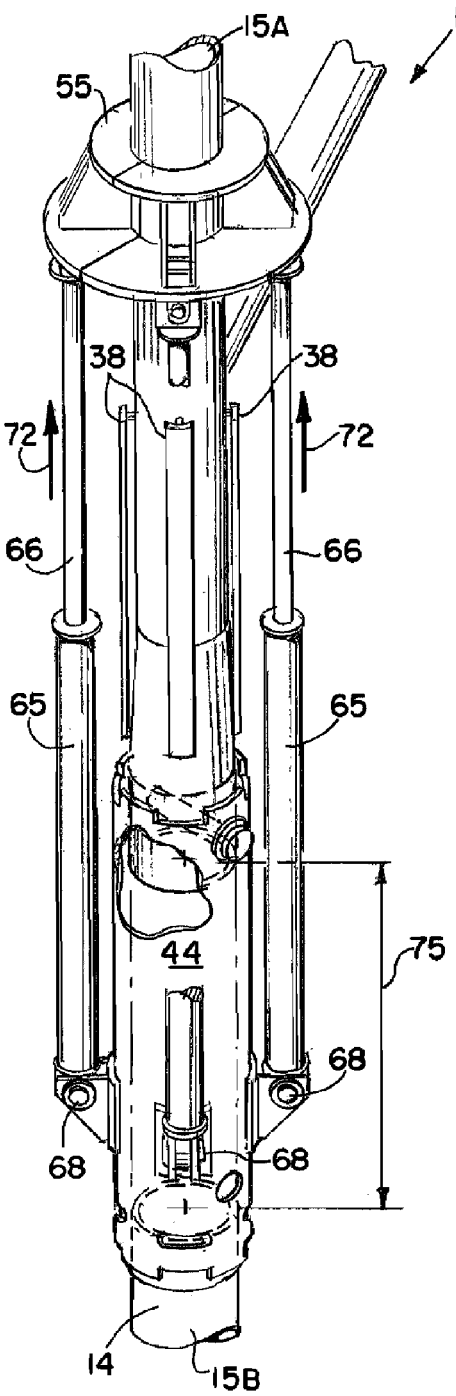
FIG. 17 is a fragmentary perspective of a preferred embodiment of the apparatus of the present invention illustrating extension of the leg with the hydraulics pistons.
Figure 18:
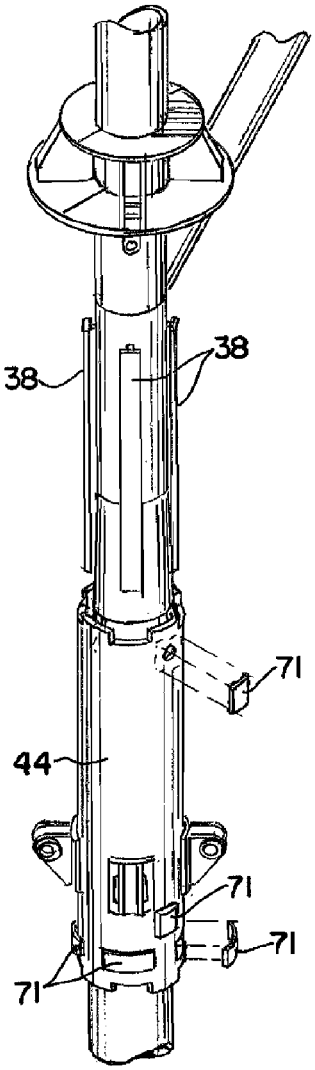
FIG. 18 is a partial perspective view of a method and apparatus of the present invention, showing a method step of closing the sleeve openings.

The present invention provides a marine platform deck elevating system 10 that is shown generally in FIGS. 14-15 and 17 and in method steps that are illustrated in FIGS. 2-18.

Figure 1:
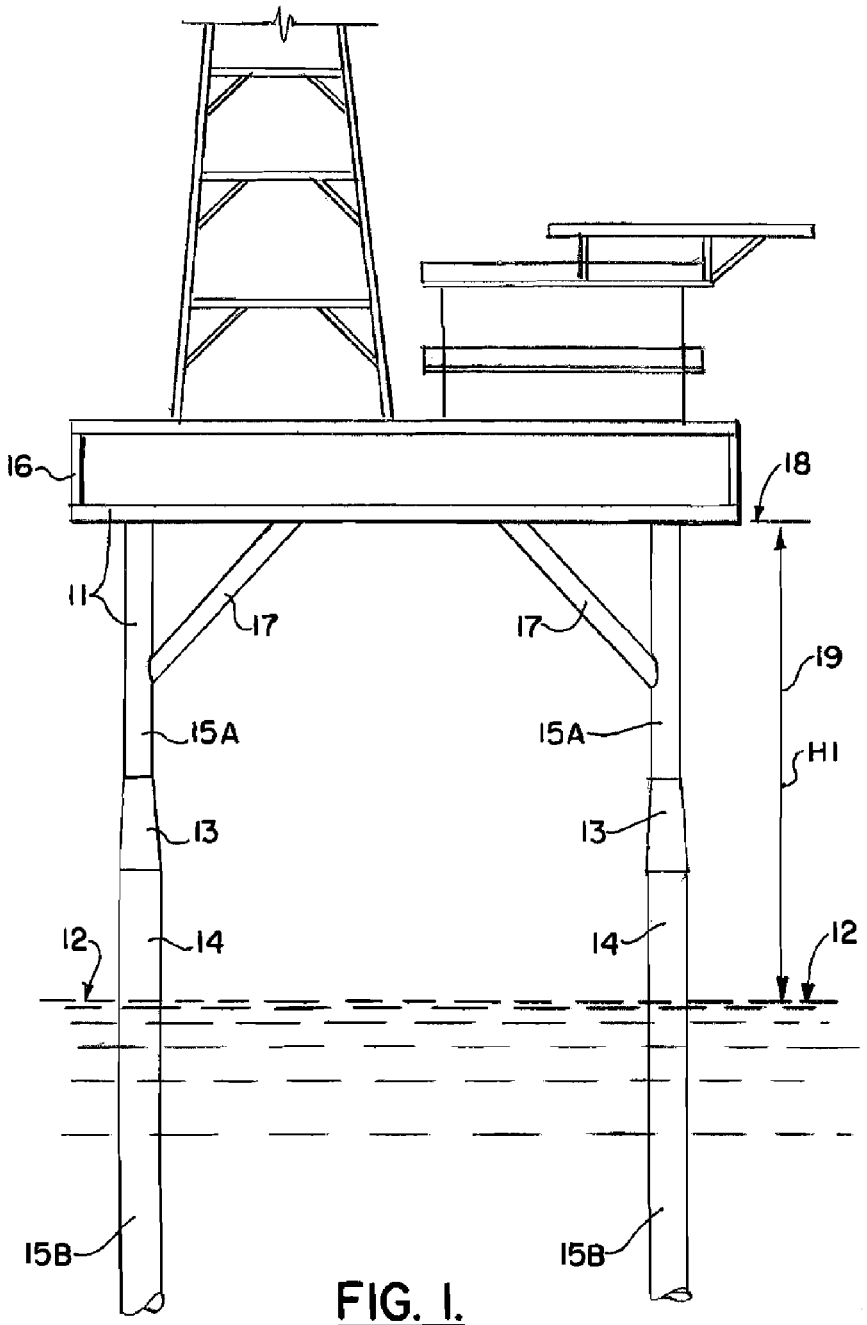
FIG. 1 is a schematic, elevation view of a fixed marine platform.

In FIG. 1, a fixed marine platform 11 is shown having a deck 16 that is positioned at an elevation 18 that is elevated above the water surface 12 a distance H1 that is indicated by the numeral 19 in FIG. 1. The numeral 19 and the dimension line H1 represent the existing clearance above water. It is necessary to protect equipment that is contained on the deck 16 from storm generated wave action. Storms such as hurricanes can generate a storm surge and wave action that puts equipment and/or personnel located on deck 16 at peril. If a deck is not located at a safe elevation, it must be elevated. FIG. 1 illustrates a typical fixed platform 11 having a plurality of legs 14 that support the deck 16. Diagonal braces 17 can extend between legs 14 and deck 16 as shown in FIG. 1. The platform 11 can include other structures such as, for example, horizontal beams or members and/or additional vertical or diagonal members.

Figure 19:
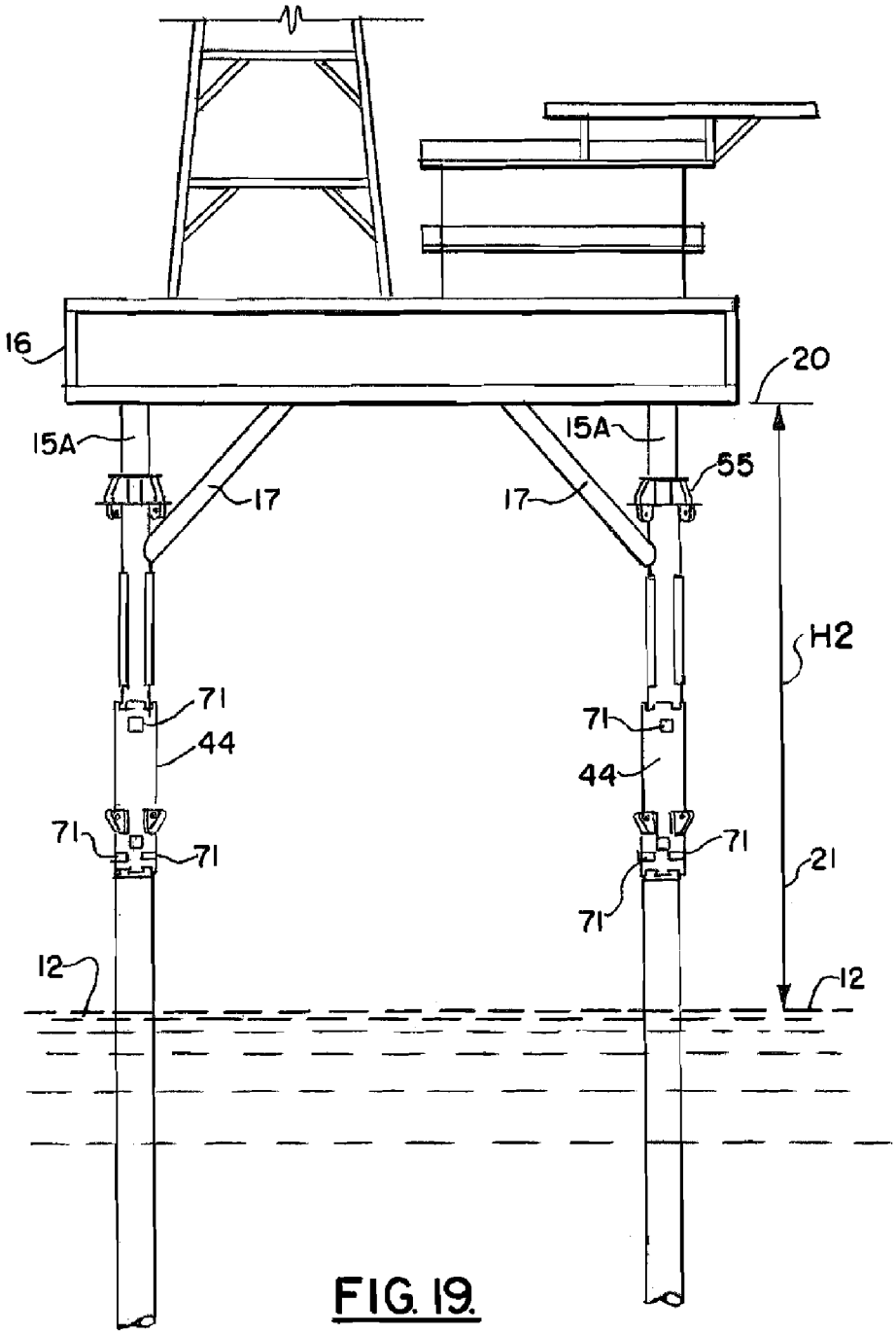
FIG. 19 is an elevation view of a preferred embodiment of the apparatus of the present invention illustrating the marine platform after its deck area has been elevated using the method and apparatus of the present invention.

Legs 14 can be of a constant diameter or can include tapered sections 13, wherein the diameter of the upper leg section 15A is less than the diameter of the lower leg section 15B. Leg 14 can thus include a number of different leg sections such as a lower, larger diameter leg section 15B, a tapered leg section 13, and an upper, smaller diameter leg section 15A that is positioned above the tapered section 13. The method and apparatus of the present invention can be used to elevate the deck 16 to a new elevation 20 (see FIG. 19) that is higher than the previous, existing deck elevation 18 of FIG. 1. The method and apparatus of the present invention thus provides a new clearance 21 above water surface 12 (also shown by the arrow H2 in FIG. 19).

Figure 2:
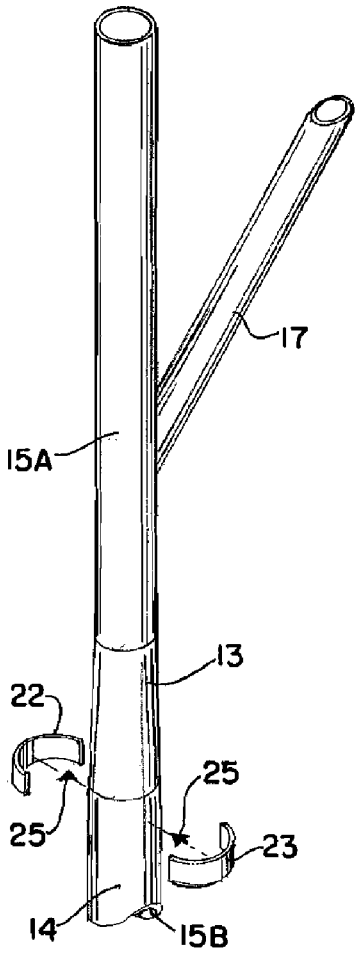
FIG. 2 is a perspective view illustrating a method step of the present invention.
Figure 3:
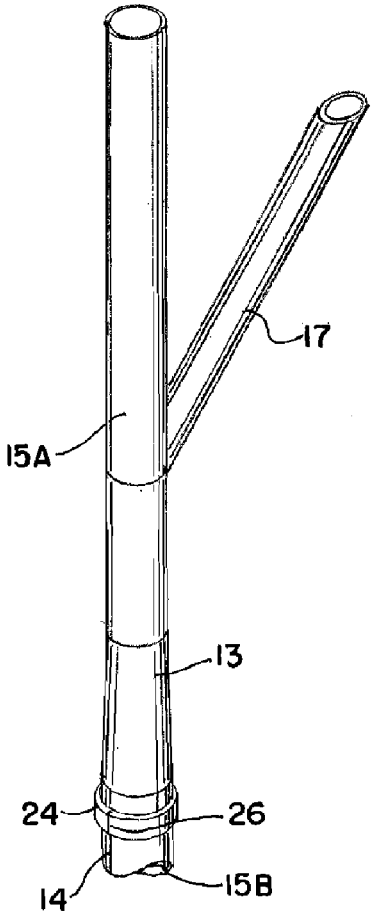
FIG. 3 is a perspective view illustrating a method step of the present invention.
Figure 4:
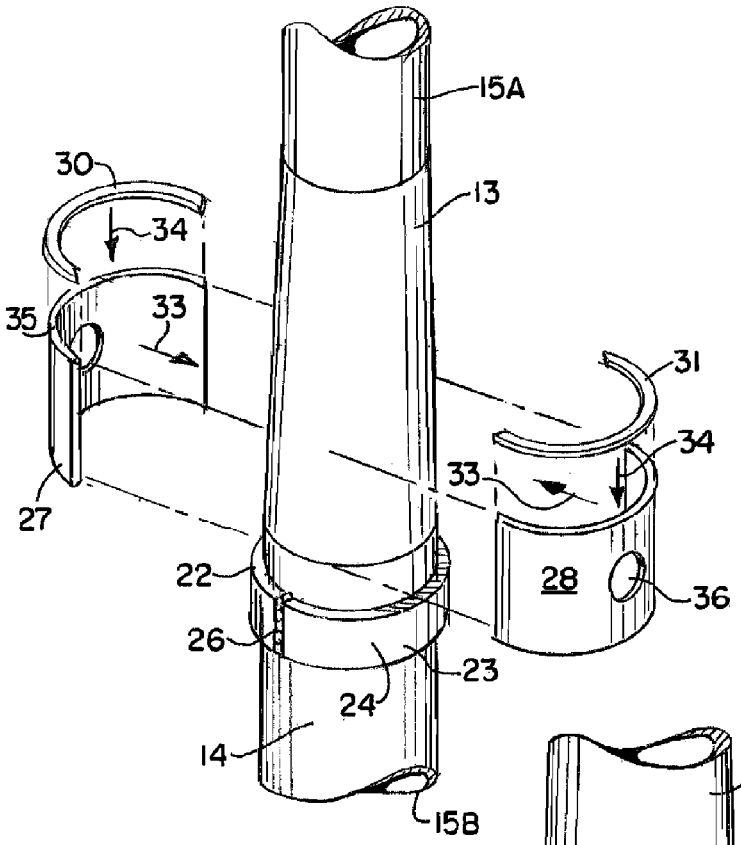
FIG. 4 is a perspective view illustrating a method step of the present invention, placement of the upper and lower bushing sleeves.

FIGS. 2 and 3 illustrate an initial method step of the present invention, namely the placement of lower bushing sleeve 24. The lower bushing sleeve 24 can be comprised of a pair of half sleeve sections 22, 23 as shown in FIGS. 2-3. The sections 22, 23 can be joined with welds 26 as shown in FIGS. 3-4. Arrows 25 in FIG. 2 schematically illustrate the placement of sleeve sections 22, 23 upon leg 14 at a position below tapered section 13 as shown.

Figure 5:
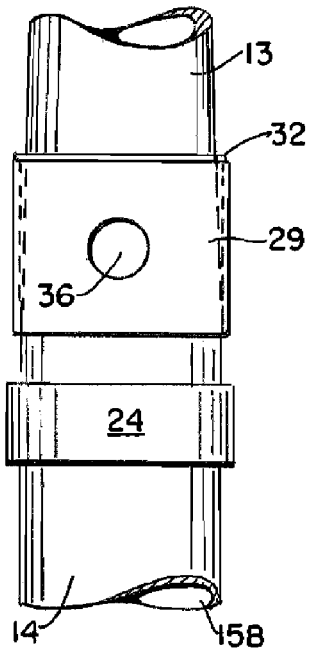
FIG. 5 is a partial perspective view of a preferred embodiment of the apparatus of the present invention illustrating placement of the upper and lower bushing sleeves.
Figure 6:
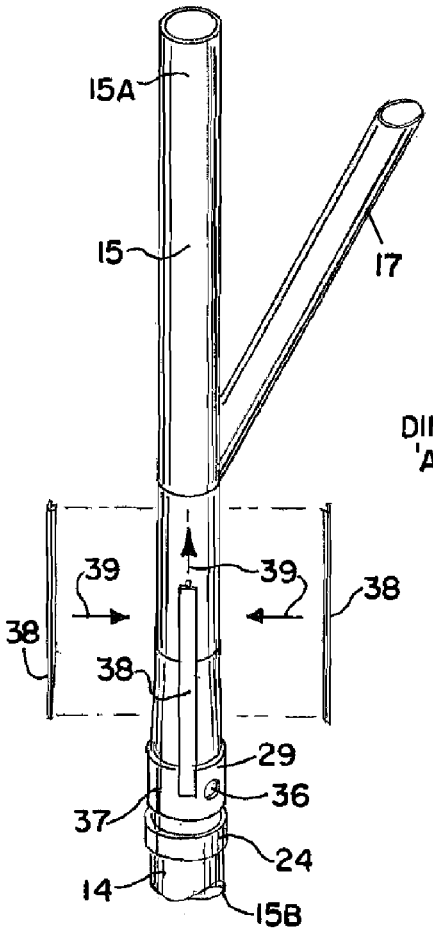
FIG. 6 is a partial perspective view of a preferred embodiment of the apparatus of the present invention illustrating a method step of the present invention.

In FIGS. 4-6, upper bushing sleeve 29 can also be comprised of a pair of sleeve half sections. The sleeve sections 27, 28 each provide an opening 35 or 36 that is receptive of a pin 50 as will be explained more fully hereinafter. Weld ring sections 30, 31 can be used to attach the sleeve sections 27, 28 to tapered section 13. As with the lower bushing sleeve 24, one or more welds 37 can be used to join the sleeve sections 27, 28 to each other. Arrows 33 in FIG. 4 illustrate the placement of sleeve sections 27, 28 upon tapered section 13. Arrows 34 in FIG. 4 illustrate the attachment of weld ring 32 to the assembly of sleeve sections 27, 28 and to tapered section 13.

Figure 7:
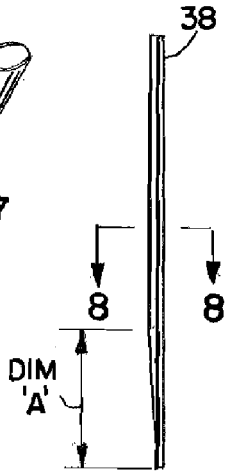
FIG. 7 is a partial perspective view of a preferred embodiment of the apparatus of the present invention illustrating one of the extension sleeve guides.
Figure 8:
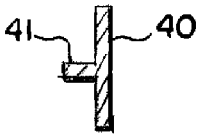
FIG. 8 is a sectional view taken along lines 8-8 of FIG. 7.
Figure 9:
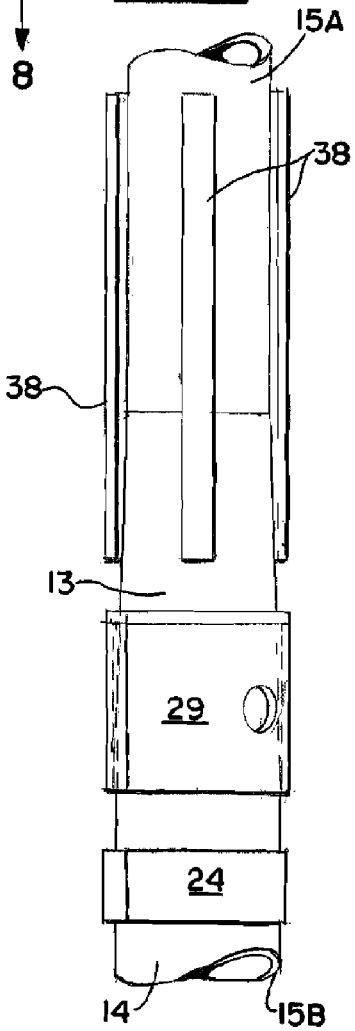
FIG. 9 is a partial elevation view of a preferred embodiment of the apparatus of the present invention illustrating placement of the extension sleeve guides.

In FIGS. 6-9 and 11, a plurality of extension sleeve guides 38 are shown. These extension sleeve guides 38 are attached to the platform 11 leg 14 at a position that is above upper bushing sleeve 29. The extension sleeve guides 38 can extend from tapered section 13 to smaller diameter leg section 15A as shown in FIGS. 6 and 9. Arrows 39 illustrate placement of extension sleeve guides 38 to leg 14. Each extension sleeve 38 can be comprised of flanges 40 and webs 41. The web 41 actually contacts the leg 14 and can be shaped to conform to the shapes of tapered section 13 and smaller diameter leg section 15A as shown in FIGS. 7 and 9 (sec DIM "GA", FIG. 7).

In FIGS. 10-15, an extension sleeve 44 can be comprised of a pair of extension sleeve sections 45, 46. Each extension sleeve section 45, 46 has slots 47, 48 that can be used to complete a cut through the leg 14 after the sleeve sections 45, 46 have been attached to leg 14 and guides 38.

Figure 10:
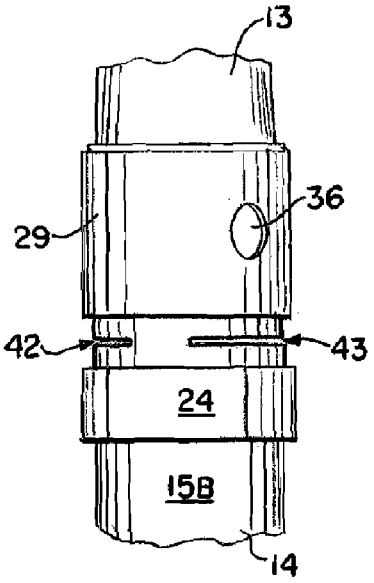
FIG. 10 is a partial elevation view of a preferred embodiment of the apparatus of the present invention showing positions of the leg cuts.

Before attachment of the sleeve sections 45, 46, four cuts are made through leg 14 as shown in FIG. 10. The cuts 42, 43 do not extend 360 degrees around the leg 14, but rather extend only a partial distance as shown in FIG. 10. Though partial cuts 42, 43 are made, enough of the leg 14 remains to structurally support the platform 11 and its deck 16 considering the use of sleeve 44 and the method of the present invention disclosed herein.

Figure 11:
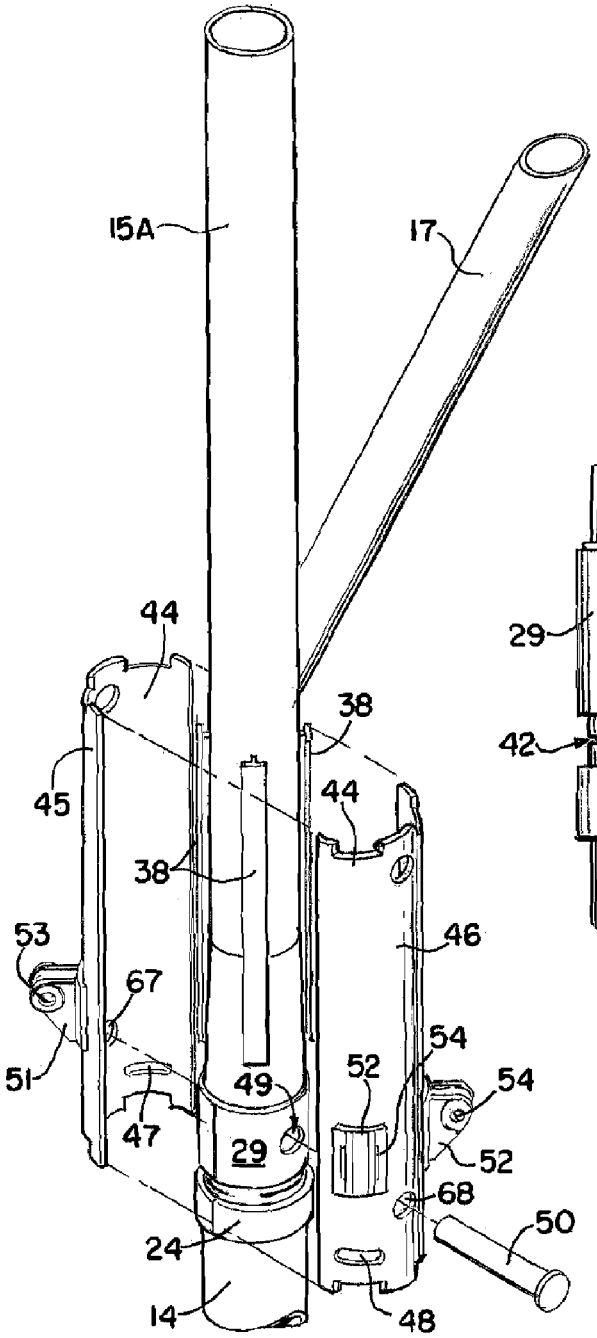
FIG. 11 is a partial perspective exploded view of a preferred embodiment of the apparatus of the present invention.

After the sleeve sections 45, 46 have been installed, a cut can be made to encircle the leg 14 thus severing it in two parts. In order to complete the cut, slots are provided in the sleeve sections 45, 46. In FIG. 11, the sleeve section 45 has slot 47. In FIG. 11, the sleeve section 46 has slot 48.

After installing the upper bushing sleeve 29, circular cut openings 49 are made through the leg 14 at the openings 35, 36 in the sleeve sections 27, 28. These cut openings 49 enable pin 50 to be placed through the openings 67, 68 in sleeve sections 45, 46 respectively as well as through the openings 49 in upper bushing sleeve 29. Pin 50 prevents uplift from damaging the platform 11 should a storm produce excess wave action before the method of the present invention can be completed.

Each of the sleeve sections 45, 46 provides lugs to which hydraulic pistons can be attached. Sleeve section 45 provides a plurality of lugs 51. Sleeve section 46 provides a plurality of lugs 52. Each of the lugs provides an opening for enabling a pinned connection to be made between the lugs 51, 52 and the hydraulic pistons 64. Lugs 51 provide openings 53. Lugs 52 provide openings 54. In a preferred method and apparatus, four pairs of lugs 51, 52 are thus provided to the extension sleeve 44. Each pair of lugs 51, 52 can be spaced circumferentially about sleeve 44, about 90 degrees apart.

Figure 12:
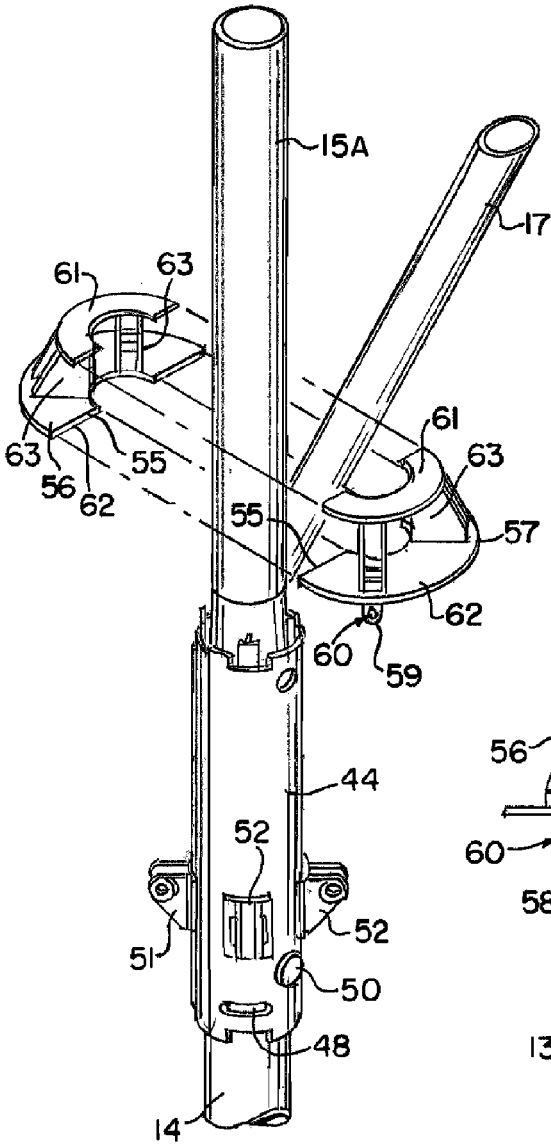
FIG. 12 is a partial perspective view of a preferred embodiment of the apparatus of the present invention illustrating the method of the present invention, placement of the upper ring.

A ring 55 is positioned above extension sleeve 44 as shown in FIGS. 12-15 and 17-19. Ring 55 is used to form a connection between the leg 14 and the hydraulic piston 64. Ring 55 can be formed of a pair of ring sections 56, 57 that are attached to the smaller diameter leg section 15A as shown in FIGS. 12 and 13. Each of the ring sections 56, 57 provides a plurality of lugs 58, 59. The ring section 56 has lugs 58. The ring section 57 has lugs 59. Each lug 58, 59 has a lug opening 60 that enables a pinned connection to be made between a lug 58 or 59 and a piston 64. Each ring section 56, 57 can be formed of arcuate generally horizontal plate sections and vertical plate sections. Each of the ring sections 56, 57 thus provide an upper arcuate plate section 61 and a lower arcuate plate section 62. Vertical plate sections 63 span between the upper and lower arcuate plate sections 61, 62.

Hydraulic pistons 64 are provided for elevating that portion of the leg 14 that is above the cuts that are made through the leg 14 (see FIGS. 10 and 16). Preferably three (3) or four (4) pistons can be used, but as few as two (2) rams can be used or more, such as many as eight (8) could be used, for example.

Each hydraulic piston 64 can be comprised of a cylinder 65 and an extensible push rod 66. Each end portion of hydraulic piston 64 provides an opening 69 on cylinder 65 that enables a pinned connection to be formed between each end of hydraulic piston 64 and lugs 51, 52 or 58, 59. The upper end portion of each hydraulic piston 64 attaches with a pinned connection to a lug 58 or 59 that is apart of ring 55. The lower end portion of each hydraulic piston 64 forms a pinned connection with the lugs 51, 52 of extension sleeve 44 as shown in FIGS. 14-15. Arrows 74 in FIG. 14 illustrate assembly of pistons 64 to lugs 51, 52, 58, 59.

Once the hydraulic pistons 64 have been installed to the position shown in FIG. 15, a cut can be completed for severing leg 14. This can be seen in more detail in FIGS. 10, 15-16 wherein the previously formed cuts 42, 43 are shown. Notice that uncut portions 70 (DIM "B", FIG. 16) of leg 14 align with the slots 47 or 48 of sleeve sections 45, 46. The leg 14 can thus be cut 360 degrees by cutting the previously uncut section 70 at slot 47 or 48, indicated by phantom lines as cut 73 in FIG. 16. The three hundred sixty degree cut (42, 43, 73) is made after the extension sleeve 14, hydraulic pistons 64 and ring 55 form a structural support of the leg 14 above and below the cuts 42, 43. In order to then elevate the smaller diameter leg section 15A relative to the larger diameter leg section 15B below tapered section 13, each hydraulic piston 64 can be activated as illustrated by arrows 72 in FIG. 17.

Once elevated, the various openings and slots in sleeve 44 can be covered for corrosion protection using a plurality of curved cover plate sections 71. To complete the repair, the sleeves 44 can be welded to the leg 14 and using shims as necessary between sleeve 44 and leg 14, tapered section 13 or sections 15A, 15B. While the method disclosed herein contemplates that the elevation process would preferably take place as one jacking operation, the invention should not be so restricted. The method of the present invention contemplates a method wherein the jacking process could be subdivided into several smaller (or shorter) jacking elevations. The legs 14 would be pinned off at an intermediate point and the jacks moved to a second set of lugs. Arrow 75 in FIG. 17 shows the distance that the upper leg section 15A is elevated.

FIGS. 20-40 show an alternate embodiment of the apparatus of the present invention designated generally by the numeral 80 in FIGS. 30-34. Marine platform deck elevating system 80 can be used to elevate the same deck 16 that was shown and described with respect to FIGS. 1-19. Therefore, the FIGS. 20-40 are schematic in that they do not show each and every part of the marine deck 16 to be elevated. FIGS. 5, 24, 29, 30 illustrate an existing deck elevation 18. The numeral 85 illustrates a spacing or clearance (for example, 20 feet (6.1 m)) between deck or upper deck 16 and a lower deck or lower deck portion 84.

Figure 30:
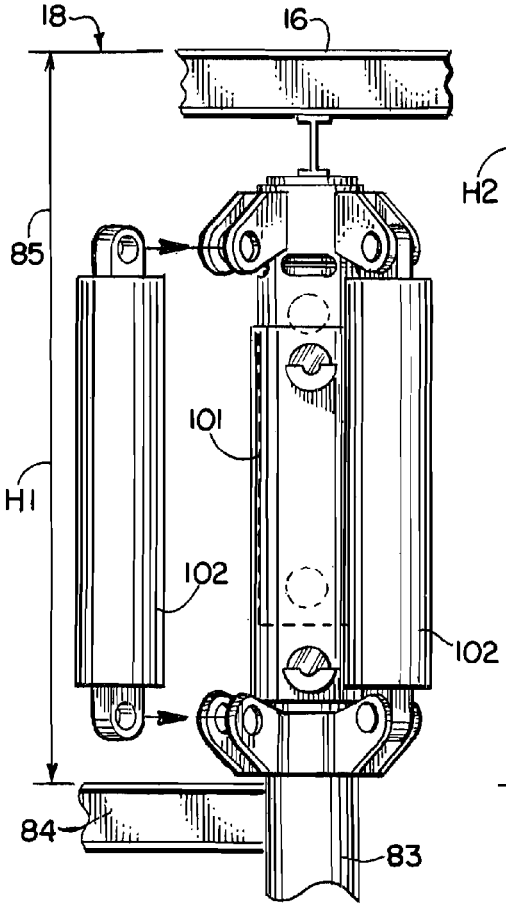
FIG. 30 is a partial elevation view of an alternate embodiment of the apparatus of the present invention showing an alternate method of the present invention.
Figure 31:
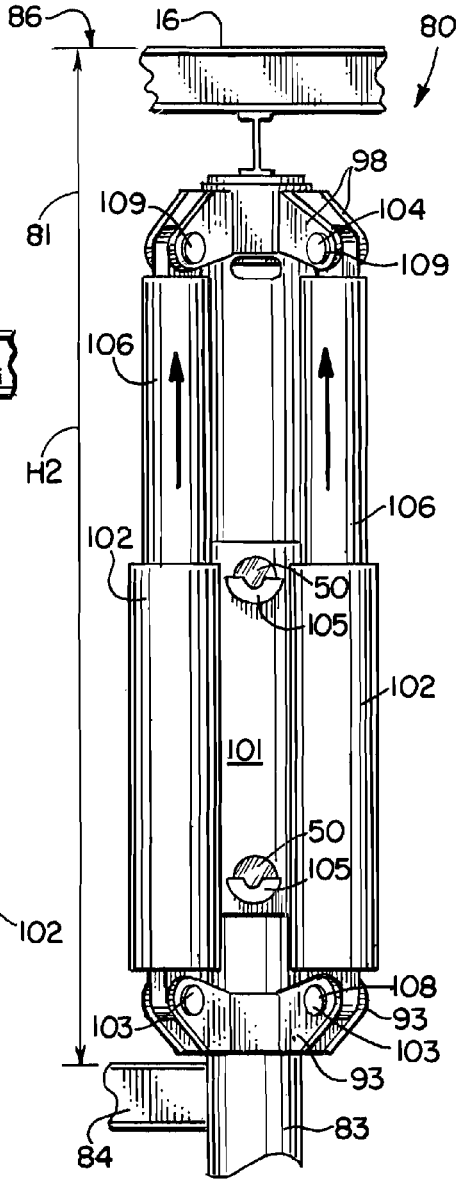
FIG. 31 is a partial elevation view of an alternate embodiment of the apparatus of the present invention showing an alternate method of the present invention.

A plurality of legs 83 span between the lower deck portion 84 and the deck or upper deck 16. Each of the legs 83 will be elevated using the method and apparatus of the present invention. An alternate method and apparatus 80 shown in FIGS. 20-40 can employ a two stage deck elevation. In FIG. 30, the existing deck elevation 18 is shown. In FIG. 31, an initial or first new deck elevation 81 is shown having a second clearance or elevation 86 (for example, 28 feet (8.5 m)). This second clearance 86 is thus an increase of 8 feet (2.4 m) (for example) over the initial clearance 85 of FIG. 20. In FIG. 31, the deck or upper deck 16 is now spaced 28 feet (8.5 m), as an example, above the lower deck portion 84.

Figure 32:
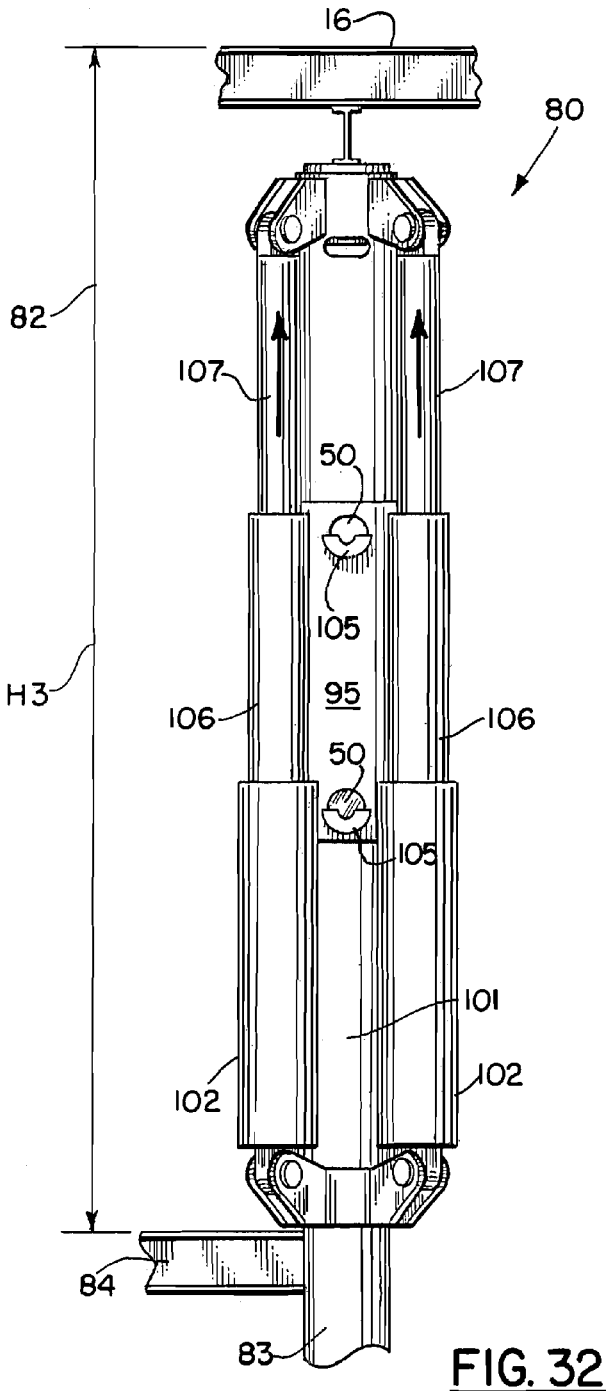
FIG. 32 is a partial elevation view of an alternate embodiment of the apparatus of the present invention showing an alternate method of the present invention.
Figure 33:
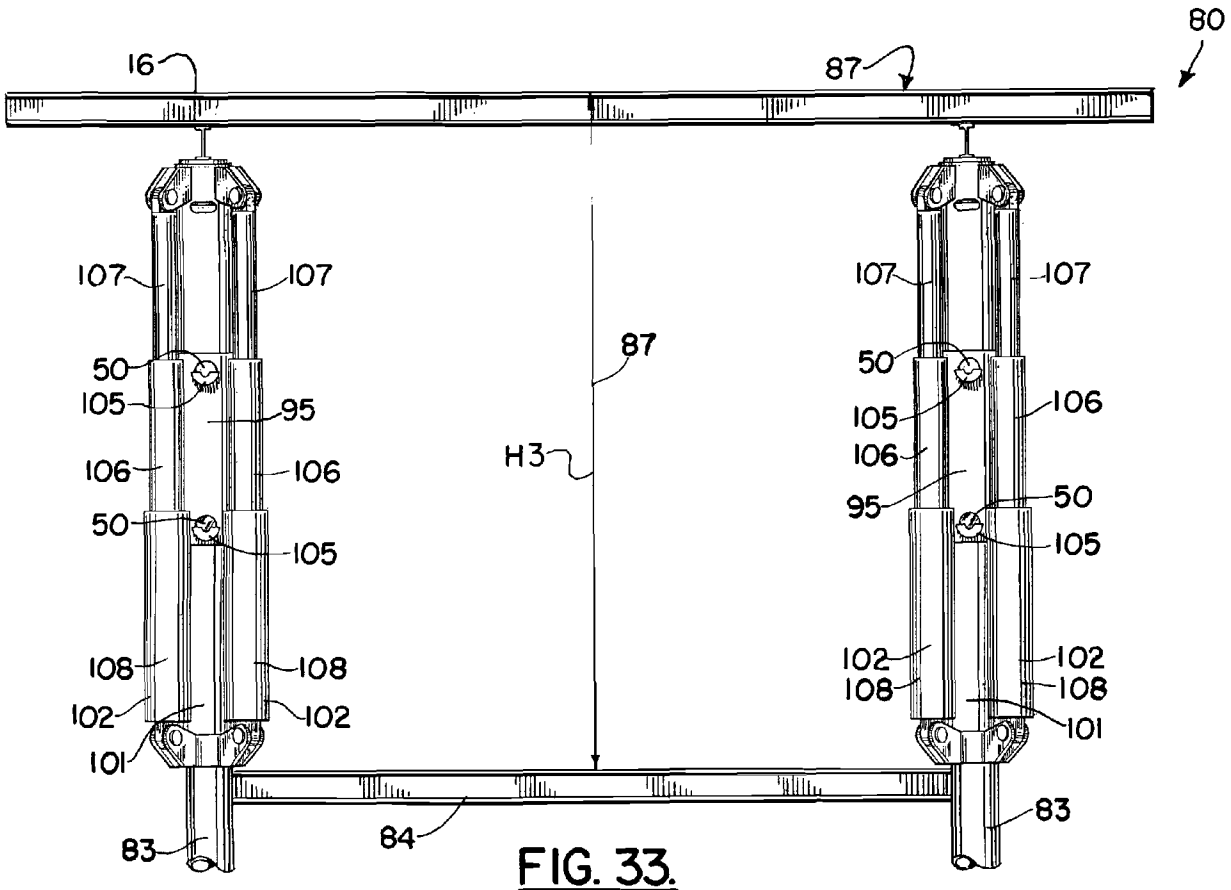
FIG. 33 is a partial elevation view of an alternate embodiment of the apparatus of the present invention showing an alternate method of the present invention.
Figure 34:
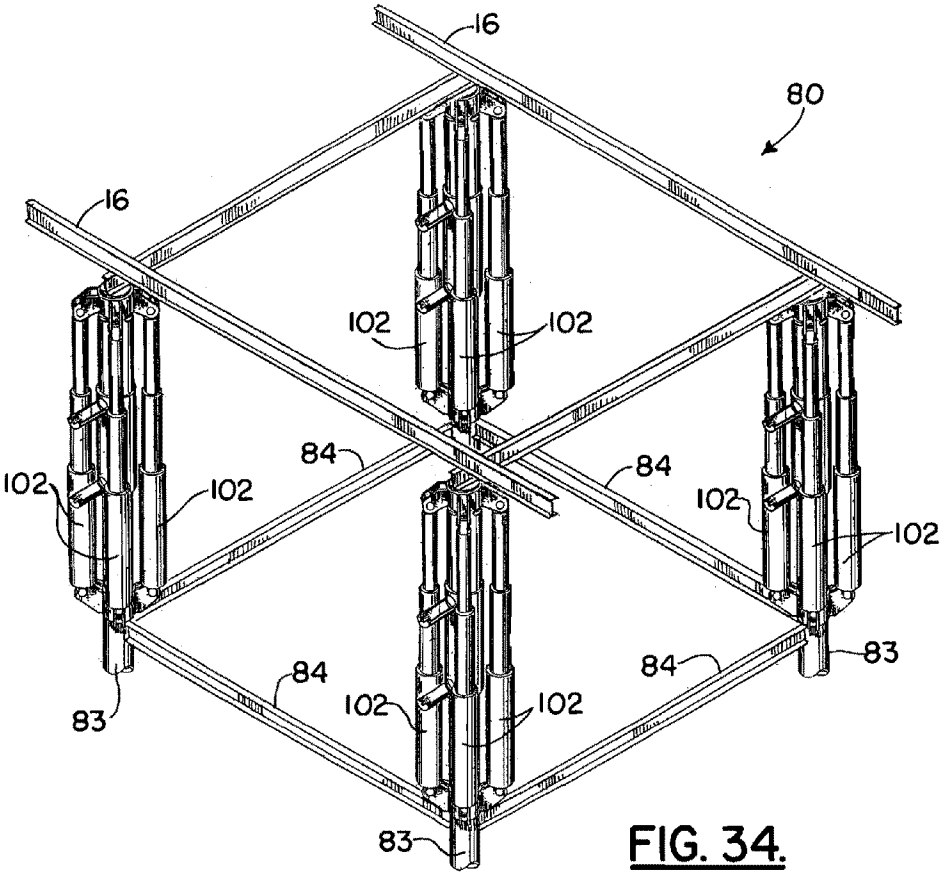
FIG. 34 is a perspective view of an alternate embodiment of the apparatus of the present invention and illustrating an alternate method of the present invention.
Figure 35:
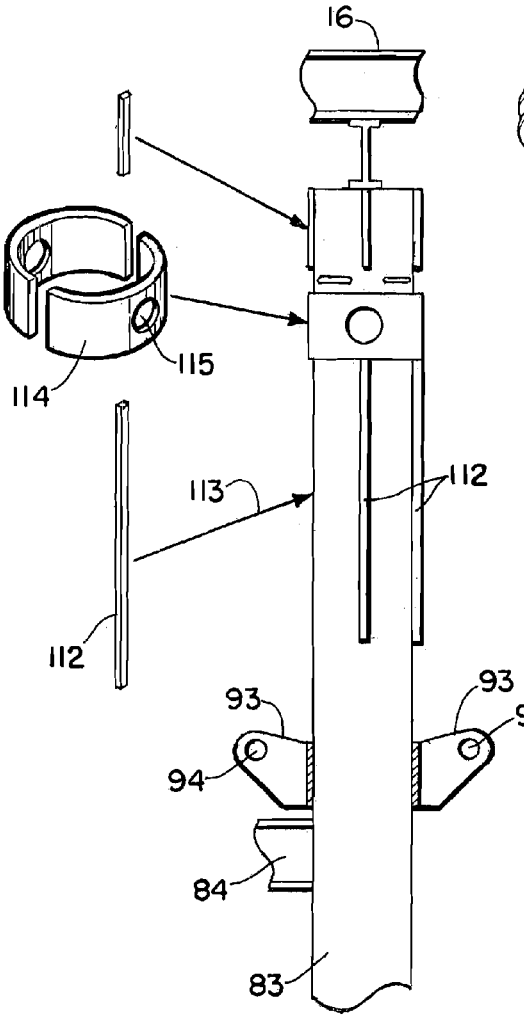
FIG. 35 is an exploded elevation view illustrating an alternate embodiment of the apparatus of the present invention and an alternate method of the present invention.
Figure 36:
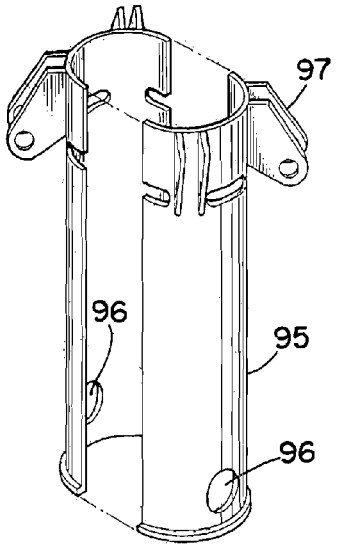
FIG. 36 is a fragmentary view of an alternate embodiment of the apparatus of the present invention.
Figure 37:
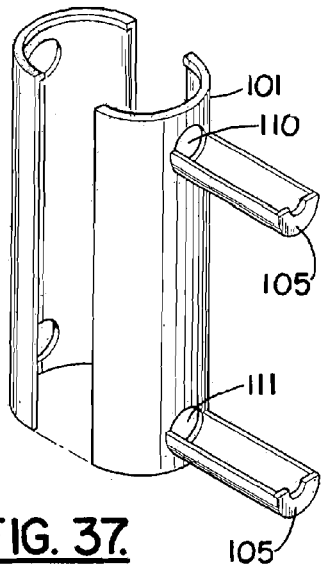
FIG. 37 is a fragmentary view of an alternate embodiment of the apparatus of the present invention.
Figure 38:
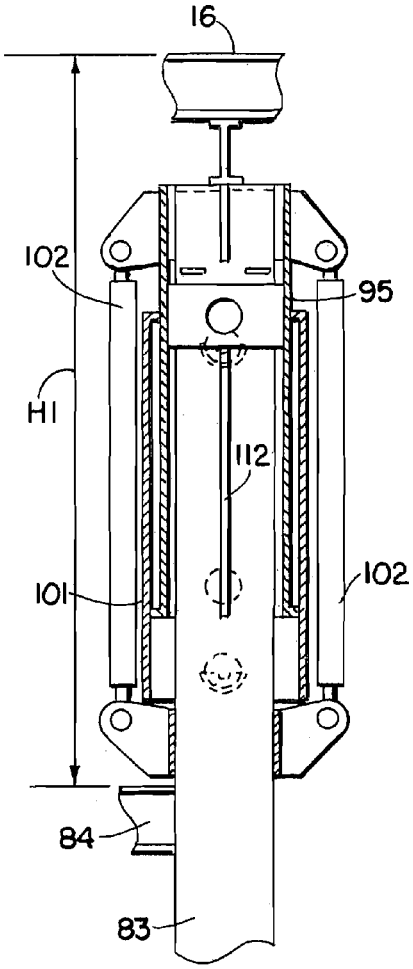
FIG. 38 is a partial sectional elevational view of an alternate embodiment of the apparatus of the present invention.
Figure 39:
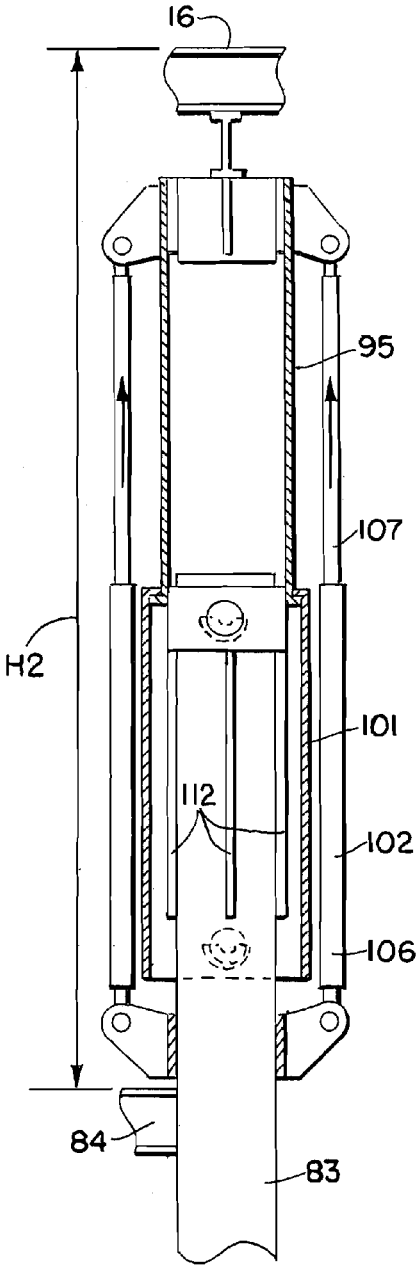
FIG. 39 is a partial sectional elevational view of an alternate embodiment of the apparatus of the present invention.
Figure 40:
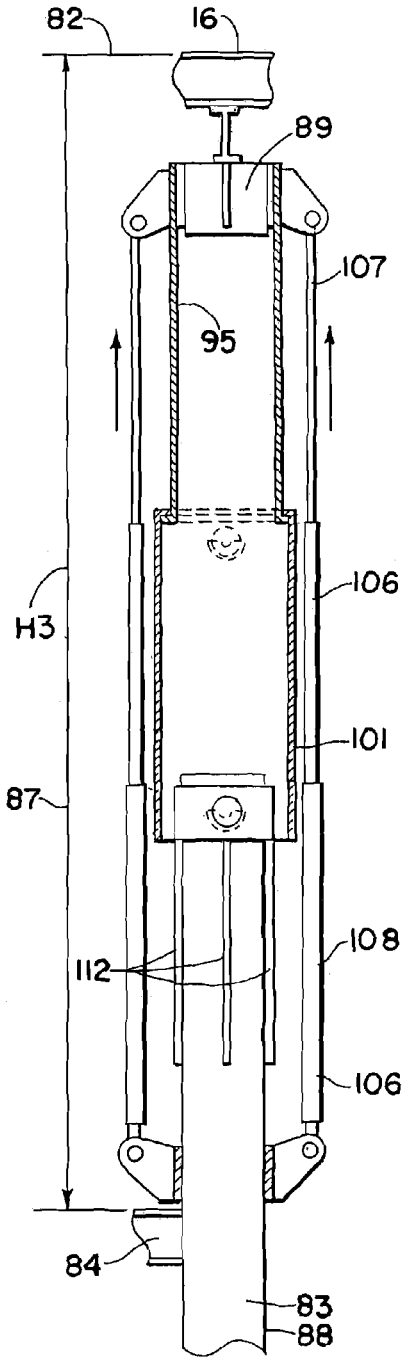
FIG. 40 is a partial sectional elevational view of an alternate embodiment of the apparatus of the present invention.

In FIG. 31, a plurality of hydraulic rams or hydraulic jacks 102 have moved from the initial and collapsed position of FIG. 30 to a partially or first elevation. In FIG. 32, the hydraulic rams 102 employed are two stage rams having a first push rod 106 and a second push rod 107 which is inside and which telescopes with the first push rod 106. Such hydraulic rams 102 are commercially available, wherein the ram 102 has a first push rod 106 that telescopes inside of a lower ram cylinder 108 and a second push rod 107 that telescopes inside of the first push rod 106. In FIGS. 32, 33, 34 and 40, the deck 16 or upper deck has been elevated an additional 8 feet (2.4 m) to elevation or level at 82 so that the clearance or third clearance 87 in FIGS. 32-34 and 40 is now a spacing or clearance of 36 feet (11 m), as an example, between lower deck portion 84 and deck or upper deck 16. In FIG. 34, four legs 83 are shown, each having been extended a full clearance 87 (36 feet (11 m) per the example).

Figure 20:
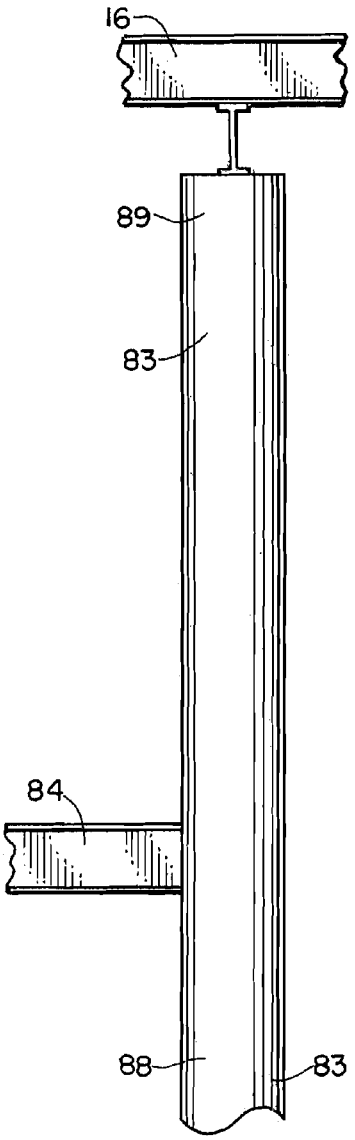
FIG. 20 is a partial elevation view of an alternate embodiment and method of the present invention illustrating an existing deck elevation prior to being elevated using an alternate embodiment of the apparatus of the present invention.
Figure 21:
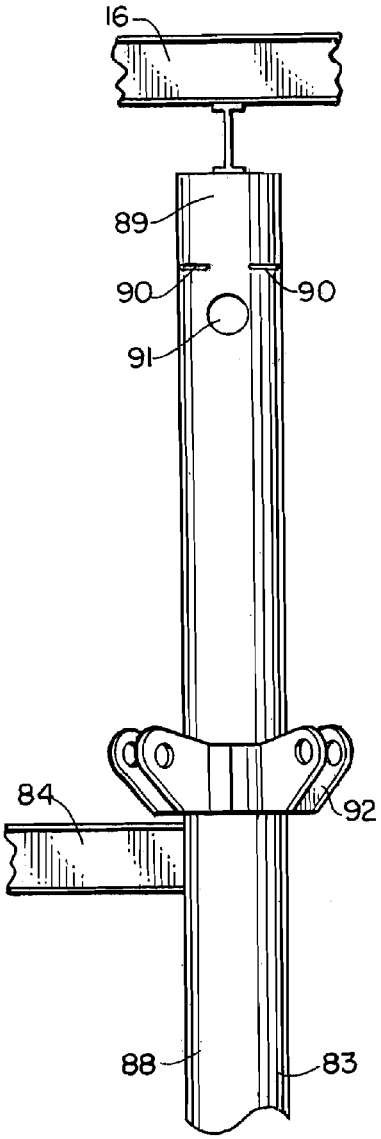
FIG. 21 is an elevation view illustrating an alternate method and apparatus of the present invention and showing an initial deck lift.
Figure 22:
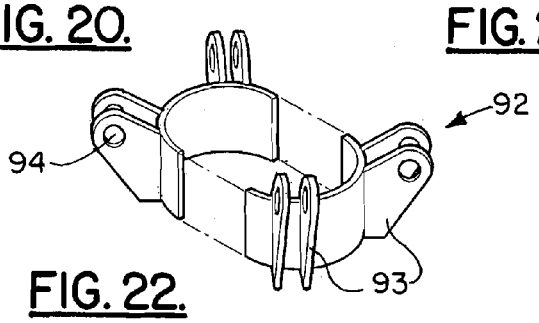
FIG. 22 is a partial perspective view of an alternate method and apparatus of the present invention.
Figure 23:
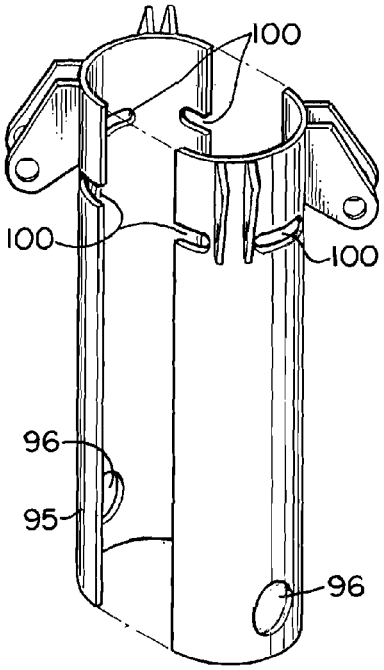
FIG. 23 is a partial perspective view of an alternate embodiment of the apparatus of the present invention.
Figure 24:
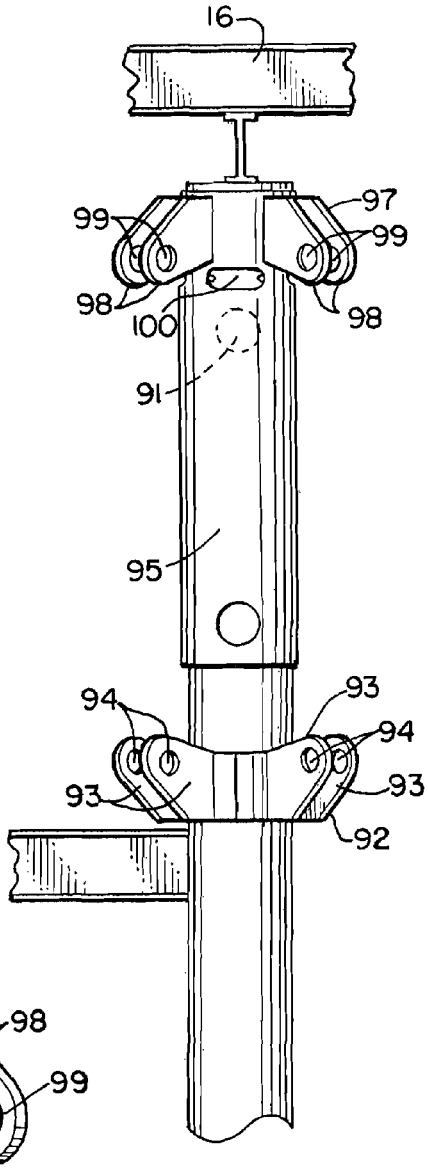
FIG. 24 is a fragmentary elevation view of an alternate embodiment of the apparatus of the present invention and alternate method.
Figure 25:
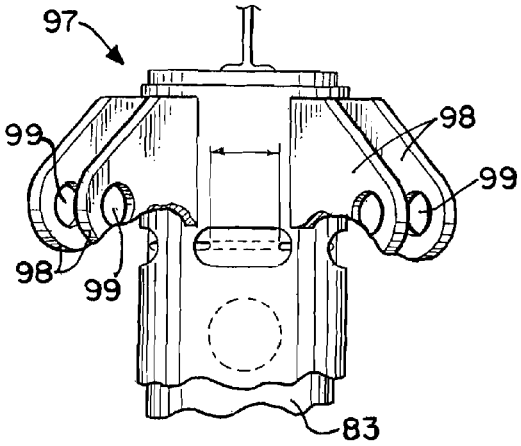
FIG. 25 is a fragmentary perspective view of an alternate embodiment of the apparatus and method of the present invention.
Figure 26:
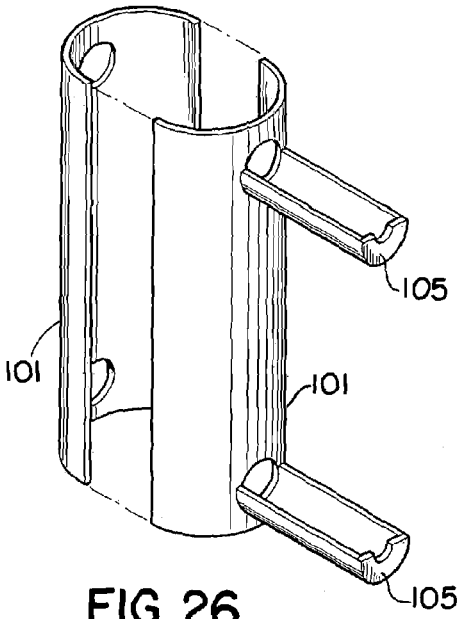
FIG. 26 is a fragmentary perspective view of an alternate embodiment of the apparatus and method of the present invention.
Figure 27:
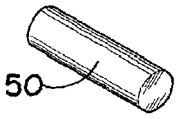
FIG. 27 is a fragmentary perspective view of an alternate embodiment of the apparatus and method of the present invention showing the locking pin.
Figure 28:
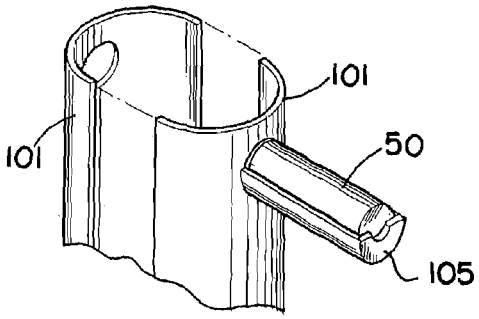
FIG. 28 is a partial perspective view of an alternate embodiment of the apparatus of the present invention illustrating a sleeve and a half-pipe pin trough that is used to support the pins prior to insertion.
Figure 29:
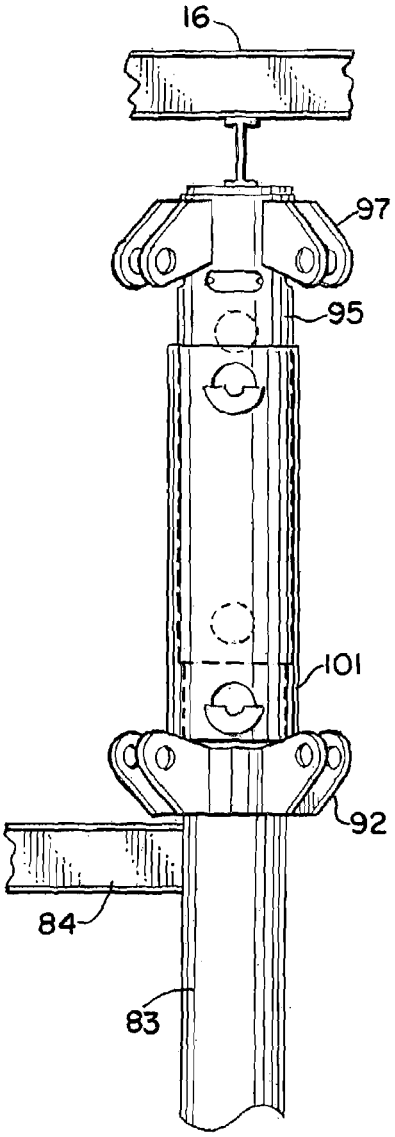
FIG. 29 is a partial elevation view of an alternate embodiment of the apparatus of the present invention showing an alternate method of the present invention.

The method and apparatus of the present invention employs two sleeves 95, 101 in order to accomplish the elevation of deck or upper deck 16 relative to lower deck portion 84. FIGS. 20-21 illustrate that each leg 83 has a lower portion 88 and an upper portion 89. Partial cuts 90 are made in the leg 83 upper portion 89. These partial cuts through the deck legs can be, for example, about 45 degrees of the circumference of the leg 83. These partial cuts 90 can also be spaced circumferentially about leg 83 in equal amounts such as a spacing of about 45 degrees apart. Pin receptive openings 91 are formed in leg 83 upper portion 89 just below the partial cuts 90 and 180 degrees apart as shown in FIG. 21. After formation of the openings 91, an inner/upper sleeve 95 is affixed to upper leg 89 above the partial cuts 90 (see FIGS. 23-25). For example, the connection of sleeve 95 to upper portion 89 of leg 83 can be a welded connection. A lower support ring 92 is attached (for example, welded) to leg 83 lower portion 88 and spaced vertically below inner/upper sleeve 95 as shown in FIG. 24. Upper ring 97 is affixed (e.g., welded) to upper portion 89. The lower support ring 92 provides a plurality of padeyes 93, namely, one for each hydraulic ram 102 or a total of four padeyes 93 for the example shown in the drawings. Each padeye 93 provides a padeye opening 94 to which a pinned connection can be made between a ram 102 and a padeye 93. Each ram 102 can have openings or sleeves or bearings at its end portions for enabling a pinned connection to be perfected with a padeye 93 or 98.

The inner/upper sleeve 95 has sleeve openings 96. Sleeve opening 96 can be provided on sleeve 95 spaced 180 degrees apart as shown in FIG. 23. Similarly, there are two openings 91 in leg 83, the openings 91 being spaced about 180 degrees apart. In this fashion, when the rams 102 extend, the openings 96 will align with the openings 91 so that a locking pin 50 (FIGS. 27, 28) can be placed through the aligned openings 91, 96. An upper ring 97 can be a part of sleeve 95. The upper ring 97 is above the partial cuts 90 as shown in FIG. 24. A plurality of padeyes 98 are affixed to ring 97, each padeye 98 providing a padeye opening 99.

Multiple windows 100 are provided. The windows 100 (for example, four windows 100) are centered over each of the uncut portions of the leg 83 that are in between the partial cuts 90. In this fashion, once the sleeves 95 and rams 102 are attached as shown, the leg 83 upper 89 and lower 88 portions are structurally supported by the combination of sleeve 95 and rams 102. Cuts can be made through the windows 100 of the sleeve 95 to cut the remaining uncut portion of leg 83 so that the leg 83 is now cut 360 degrees and ready for elevation of upper part 89 relative to lower part 88.

In FIGS. 29-33 and 38-40, an outer/lower sleeve 101 is attached to leg 83 in between the bottom of sleeve 95 and the lower support ring 92. Pinned connections 103 join each hydraulic ram 102 to the padeyes 93 of lower support ring 92 at openings 94. A lower ram pin 108 is shown in FIG. 31 forming a pinned connection between hydraulic ram 102 and a pair of padeyes 93. Similarly, a pinned connection 104 is formed between second push rod 107 of hydraulic ram 102 and padeyes 98 at openings 99. In FIG. 31, an upper ram pin 109 is shown making a connection between push rod 107 and padeyes 98 at openings 99.

A pin trough 105 can be employed (e.g., welded to a sleeve 95, 101 as shown) for holding a generally cylindrically shaped locking pin 50 prior to use. The pins 50 can be placed in the trough (see FIG. 28) and retained in that position until they are ready to be deployed. Locking pins 50 can thus be inserted in case of storm conditions when a first stage of the lift is completed as shown in FIG. 21 wherein the pin 50 would extend through to spaced apart openings 110 at the top of the lower/outer sleeve 101 through both openings 96 in the upper/inner sleeve 95 and through both openings 91 of the leg 83.

In a fully extended position of FIGS. 32-34 and 40, pin 50 is inserted through both openings 111 at the lower end of the outer sleeve 101 and the openings 91 of the leg 83. A pin 50 is also inserted through the upper opening 110 of the outer/lower sleeve 101 and through the openings 96 of the inner/upper sleeve 95 as shown in FIGS. 32-34 and 40. After installation, each sleeve 95, 101 is connected (e.g., welded) to leg 83. Inner sleeve 95 is welded to upper portion 89 of leg 83. Outer sleeve 101 is welded to lower portion 88 of leg 83. The sleeves 95, 101 are connected (e.g., welded) together once full elevation (FIGS. 22, 23) is reached. Strokes or vertical spacers 112 can be placed (e.g., welded) on each leg 83 (see FIGS. 35, 38-40) as shown by arrow 113. Collar 114 having openings 115 can be used to reinforce leg 83 at openings 91.

The following is a list of parts and materials suitable for use in the present invention.

PARTS LIST

| Part Number | Description |
|---|---|
| 10 | marine platform deck elevating system |
| 11 | platform |
| 12 | water surface |
| 13 | tapered section |

-continued

| Part Number | Description |
|---|---|
| 14 | leg |
| 15A | smaller diameter leg section |
| 15B | larger diameter leg section |
| 16 | deck/upper deck |
| 17 | diagonal brace |
| 18 | existing deck elevation |
| 19 | existing clearance above water |
| 20 | new deck elevation |
| 21 | new clearance above water |
| 22 | sleeve section |
| 23 | sleeve section |
| 24 | lower bushing sleeve |
| 25 | arrow |
| 26 | weld |
| 27 | sleeve section |
| 28 | sleeve section |
| 29 | upper bushing sleeve |
| 30 | weld ring section |
| 31 | weld ring section |
| 32 | weld ring |
| 33 | arrow |
| 34 | arrow |
| 35 | opening |
| 36 | opening |
| 37 | weld |
| 38 | extension sleeve guide |
| 39 | arrow |
| 40 | flange |
| 41 | web |
| 42 | cut |
| 43 | cut |
| 44 | extension sleeve |
| 45 | extension sleeve section |
| 46 | extension sleeve section |
| 47 | slot |
| 48 | slot |
| 49 | drilled/circular cut opening |
| 50 | support/locking pin |
| 51 | lug |
| 52 | lug |
| 53 | opening |
| 54 | opening |
| 55 | ring |
| 56 | ring section |
| 57 | ring section |
| 58 | lug |
| 59 | lug |
| 60 | lug opening |
| 61 | upper arcuate plate section |
| 62 | lower arcuate plate section |
| 63 | vertical plate section |
| 64 | hydraulic piston |
| 65 | cylinder |
| 66 | push rod |
| 67 | opening |
| 68 | opening |
| 69 | opening |
| 70 | uncut portion |
| 71 | cover plate |
| 72 | arrows |
| 73 | cut |
| 74 | arrow |
| 75 | arrow |
| 80 | marine platform deck elevating system |
| 81 | first new deck elevator |
| 82 | second new deck elevator |
| 83 | leg |
| 84 | lower deck portion |
| 85 | initial clearance |
| 86 | second clearance |
| 87 | third clearance |
| 88 | lower portion |
| 89 | upper portion |
| 90 | partial cut |
| 91 | pin receptive opening |
| 92 | lower support ring |
| 93 | padeye |

-continued

| Part Number | Description |
|---|---|
| 94 | padeye opening |
| 95 | inner/upper sleeve |
| 96 | sleeve opening |
| 97 | ring |
| 98 | padeye |
| 99 | padeye opening |
| 100 | window |
| 101 | outer/lower sleeve |
| 102 | hydraulic ram |
| 103 | pinned connection |
| 104 | pinned connection |
| 105 | pin trough |
| 106 | first push rod |
| 107 | second push rod |
| 108 | lower ram pin |
| 109 | upper ram pin |
| 110 | upper opening |
| 111 | lower opening |
| 112 | stroke/vertical spacer |
| 113 | arrow |
| 114 | collar |
| 115 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of elevating a marine platform that is supported by a plurality of hollow metallic leg sections that extend above and below a water line of a body of water, said platform having a deck supported by the leg sections, comprising the steps of:

a) cutting one of the leg sections to provide a cut at a selected elevation;

b) attaching a plurality of hydraulic rams to the leg sections and below the deck, each ram having a hollowed cylinder and an extensible push rod and first and second end portions, the rams being attached to the leg section at the end portions, one end portion being attached to the leg section and not the deck above the cut and the other end portion being attached to the leg section below the cut, and wherein each ram has a retracted and an extended position;

c) repeating steps "a" through "b" for the other leg sections of the platform;

d) elevating the platform by extending each ram to the extended position;

e) attaching a splice in between the leg sections; and f) affixing lugs above and below the cut and attaching the rams to the leg sections at the lugs.

2. The method of claim 1 further comprising placing the rams on the outside of the leg section and circumferentially spacing the rams.

3. The method of claim 1 wherein the splice is welded to the leg section above the cut and welded to the leg section below the cut.

4. The method of claim 1 wherein in step "b" there are at least three rams attached to each leg section.

5. The method of claim 1 wherein in step "b" there are between two (2) and eight (8) rams attached to each leg section.

6. The method of claim 1 wherein each leg section is elevated above the cut a distance of more than four feet (1.2 m).

7. The method of claim 1 wherein each leg section is elevated above the cut a distance of more than five feet (1.5 m).

8. The method of claim 1 wherein each leg section is elevated above the cut a distance of between about 5 and 30 feet (1.5 and 9.1 m).

9. The method of claim 1 wherein each leg section is carrying a load of between 100 and 2,000 tons (90.7 and 1,814 metric tons).

10. The method of claim 1 wherein the ram has first and second telescoping rod portions comprising said push rod.

11. The method of claim 1 wherein the ram has first, second and third telescoping rod portions comprising said push rod.

12. A method of elevating a marine platform that is supported by a plurality of hollow metallic leg sections that extend above and below a water line of a body of water, said platform having a deck supported by the leg sections, comprising the steps of:

a) cutting one of the leg sections to provide a cut at a selected elevation;

b) attaching a plurality of hydraulic rams to the leg sections and below the deck, each ram having a hollowed cylinder and an extensible push rod and first and second end portions, the rams being attached to the leg section at the end portions, one end portion being attached to the leg section and not the deck above the cut and the other end portion being attached to the leg section below the cut, and wherein each ram has a retracted and an extended position;

c) repeating steps "a" through "b" for the other leg sections of the platform;

d) elevating the platform by extending each ram to the extended position;

e) attaching a splice in between the leg sections; and f) temporarily supporting the leg section above the cut with a pin that extends through aligned openings of the leg section.

13. The method of claim 12 further comprising reinforcing the leg section next to the pin with a section of curved plate welded to the leg section on its outer surface.

14. The method of claim 12 further comprising the step of welding the splice to the leg.

15. The method of claim 12 wherein the splice is welded to the leg section above the cut and welded to the leg section below the cut.

16. The method of claim 12 wherein the ram has first and second telescoping rod portions comprising said push rod.

17. The method of claim 12 wherein in step "b" there are between two (2) and eight (8) rams attached to each leg section.

18. The method of claim 12 wherein each leg section is elevated above the cut a distance of more than four feet (1.2 m).

19. The method of claim 12 wherein each leg section is elevated above the cut a distance of more than five feet (1.5 m).

20. The method of claim 12 wherein each leg section is elevated above the cut a distance of between about 5 and 30 feet (1.5 and 9.1 m).

21. The method of claim 12 wherein each leg section is carrying a load of between 100 and 2,000 tons (90.7 and 1,814 metric tons).

* * * * *